United States Patent [19]

Craig

[11] 3,938,857

[45] Feb. 17, 1976

[54] ROCKER SPRING UNIT

[75] Inventor: Charles H. Craig, Fort Smith, Ark.

[73] Assignee: Hickory Springs Manufacturing Company, Hickory, N.C.

[22] Filed: Apr. 23, 1973

[21] Appl. No.: 353,502

[52] U.S. Cl. ..... 297/263; 248/425

[51] Int. Cl. ..... A47c 3/02

[58] Field of Search ..... 297/263, 267, 266, 265, 297/264, 261; 248/425, 385, 379, 382

[56] References Cited

UNITED STATES PATENTS

| | | | |
|---|---|---|---|
| 523,839 | 7/1894 | Lazear | 297/263 |
| 3,053,570 | 9/1962 | Fox | 297/263 |
| 3,190,693 | 6/1965 | Underdown | 297/263 |
| 3,547,393 | 12/1970 | Gordin | 297/263 |

FOREIGN PATENTS OR APPLICATIONS

| | | | |
|---|---|---|---|
| 1,200,942 | 7/1959 | France | 297/267 |

*Primary Examiner*—Francis K. Zugel
*Attorney, Agent, or Firm*—Richards, Shefte & Pinckney

[57] ABSTRACT

A rocker spring unit utilizes separately formed rocker elements and outboard rocker springs. The rocker springs and rocker elements are assembled with two plate members having the rocker springs extended between opposite plate member edges and the rocker elements mounted at inner faces of the plate members inboard of the rocker springs in paired relation to each other and in symmetrical relation to the rocker springs.

8 Claims, 5 Drawing Figures

Fig. 1
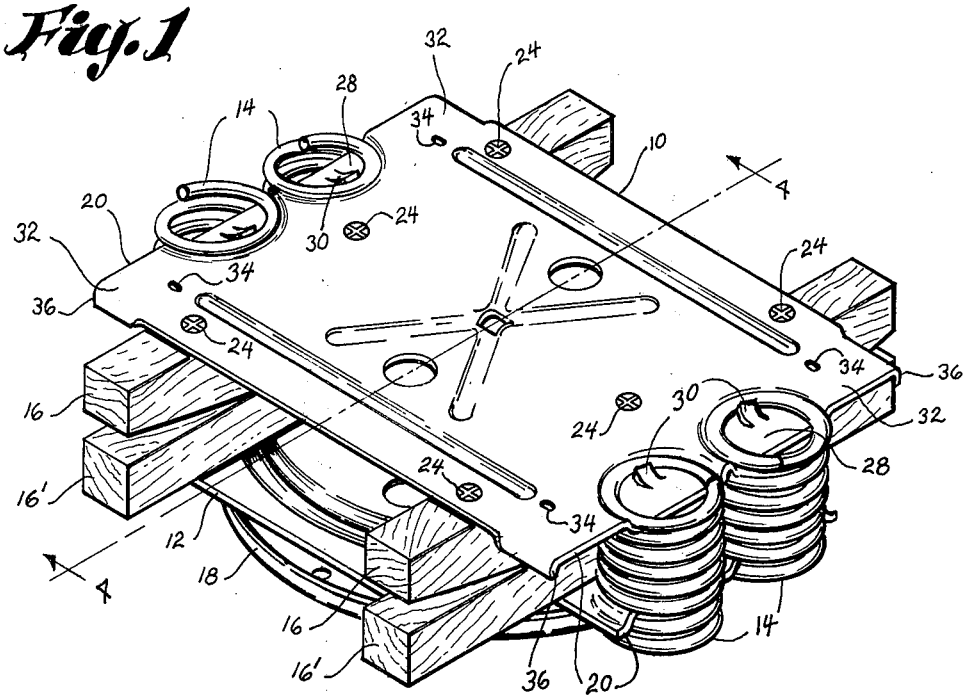
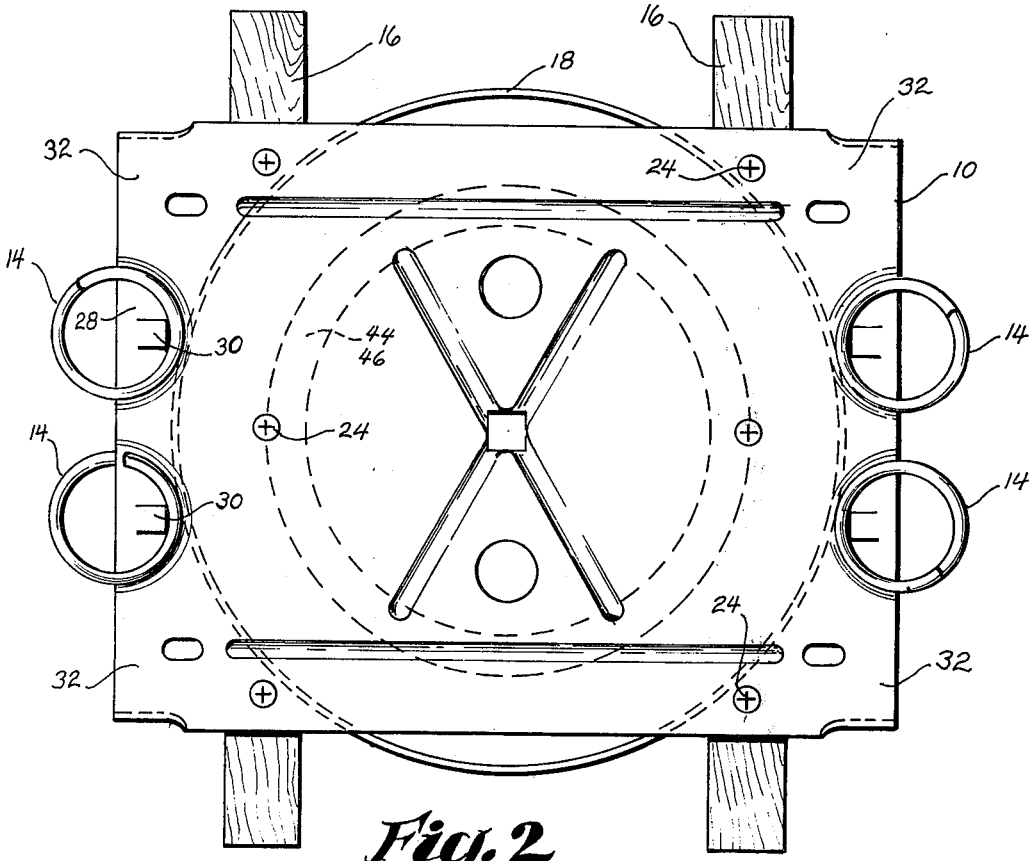
Fig. 2

24
28
32
34
26
36
30
14
22
16
16'
38
40
44
12
20

ROCKER SPRING UNIT

BACKGROUND OF THE INVENTION

The present invention relates to rocker spring units which provide controlled rocking capability to chairs in which they are used. More particularly, the present invention relates to rocker spring units of the foregoing sort which are also adaptable for use with a swivel means to provide the rocker chairs in which they are used with controlled swiveling capability.

A functional rocker spring unit of the type described herein is disclosed in U.S. Pat. No. 3,190,693. The swivel rocker unit of this patent utilizes a base member which is arranged for swivel mounting on a swivel means and which has upwardly extending opposite side portions that are flanged outwardly along their upper edges to present elongated rocker supporting areas. Also included is a bracket component of complementary form in that it has corresponding downwardly extending opposite side portions that are flanged outwardly at the lower edges to present curved rocker surfaces which engage and ride upon the base member support areas. The rocker springs are attached to the inside of the base member's upwardly extending side portions and also to the upper face of the bracket component. Apertured outwardly extending tab sections cut from the side portion of the bracket component are provided for chair frame attachment.

The rocker spring unit of this prior patent offers significant advantages, but it is rather difficult to assemble because of the internal disposition of the rocker springs. Also, the chair frame attachment tabs, being cut from the side portions of the bracket component, are difficult to strengthen adequately, and difficulty has been encountered in maintaining the rocker surfaces in riding position consistently during use of the unit because of the necessarily narrow width of the rocker surfaces and support areas.

Such difficulties are eliminated, and a rocker spring unit of much simplified construction is provided, by the present invention.

SUMMARY OF THE INVENTION

The rocker spring unit of the present invention has top and bottom plate members, rocker springs attached to the plate members, and rocker elements mounted in paired relation on the respective inner faces of the plate members. The rocker springs are extended between opposite edge portions of the respective plate members and the rocker elements are mounted inboard of the rocker springs in symmetrical relation to the attachment of the rocker springs at the opposite edge portions of the plate members. Preferably, two pairs of inboard rocker elements are mounted on rectangularly shaped plate members in parallel relation to opposite side edge portions thereof.

The combination of inboard rocker elements and outboard springs permits easy assembly of the springs to the opposed plates to form the completed unit and allows the top plate to extend outward to provide easily accessible lands for use in attaching the plate to a chair bottom without requiring attaching tabs struck from downturned rocker flanges as in the aforementioned prior patent. Furthermore, the use of rocker elements rather than flanges formed on the plates allows the rocker elements to be of any width sufficient to provide reliable rocker element contact and strength while utilizing the preassembly advantages of an opposed plate construction, and also allows the rocker elements to be made of any desired material, such as wood, plastic, or other suitable material, without limitation to the material of the plate.

Preferably, the inboard rocker elements are formed of wood with the rocker elements mounted on the top plate member having a downwardly facing lengthwise convex curvature to ride rocker elements mounted on the bottom plate that have an upwardly facing level surface. Rocker elements of wood or the like are, of course, old in the art as shown by U.S. Pat. No. 2,625,983, for example, but insofar as I am aware, such rocker elements have not heretofore been employed in rocker spring units of the sort dealt with here and have not been proposed in any combination offering advantages comparable to that of the present invention as described further below in connection with the accompanying drawings.

BRIEF DESCRIPTION OF THE DRAWINGS

FIG. 1 is a perspective view of a rocker spring unit embodying the present invention;

FIG. 2 is a plan of the device illustrated in FIG. 1;

DESCRIPTION OF THE PREFERRED EMBODIMENT

Figure 3:
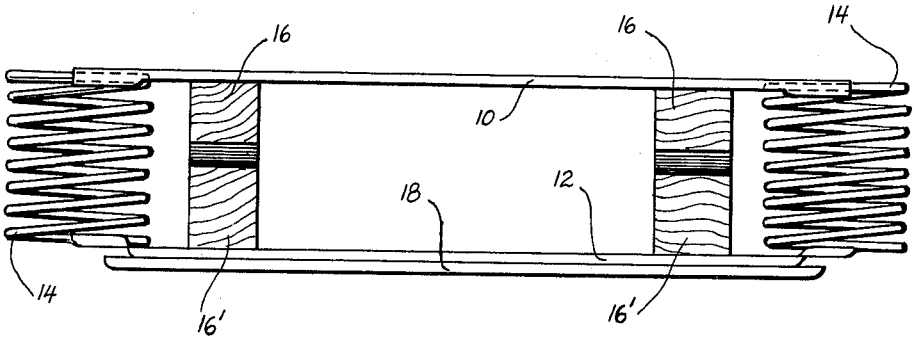
FIG. 3 is a front elevation of the device illustrated in FIG. 1.

The rocker spring unit embodying the present invention that is shown in the drawings includes a rectangular top plate member 10, a rectangular bottom plate member 12, rocker springs 14, rocker elements 16 and 16', and a swivel base 18. The top and bottom plate members 10, 12 are aligned vertically and four rocker springs 14 are attached to and extend between these plate members in pairs at opposite side edge portions 20 thereof, allowing easy positioning of the rocker springs 14 at the side edge portions 20 of the plate members 10, 12 to assemble the unit. Four rocker elements 16 and 16' are also mounted in paired relation on the respective inner faces of the top and bottom plate members 10, 12 in parallel relation to the opposite side edge portions 20 thereof and to the attachment of the rocker spring pairs 14 thereat, and in inboard adjacent relation to the rocker spring pairs 14. Finally, the bottom plate member 12 is assembled with the swivel base 18 in the usual manner as noted further below.

Figure 4:
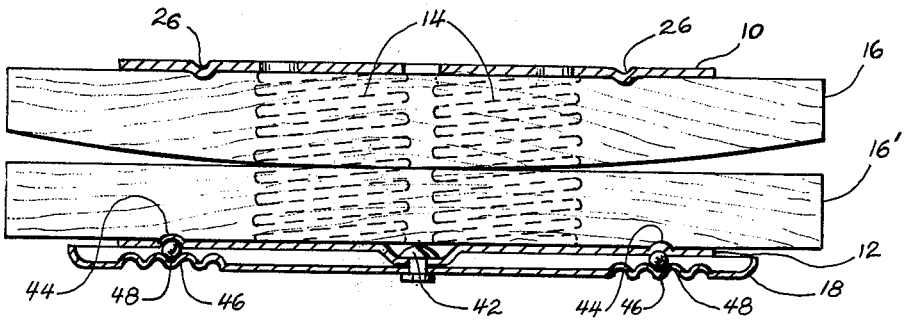
FIG. 4 is a vertical section taken along line 4—4 of FIG. 1.
Figure 5:
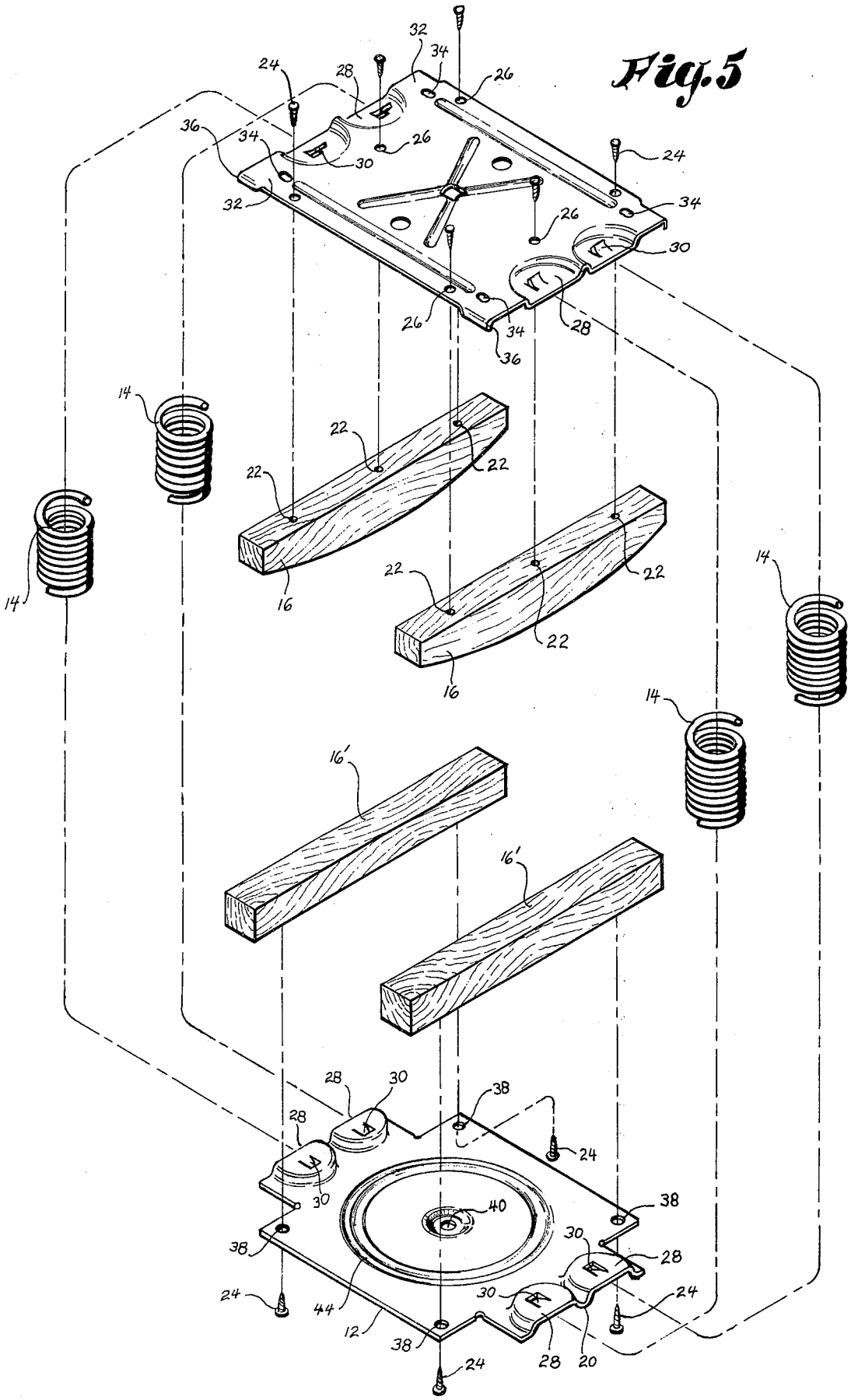
FIG. 5 is an exploded perspective view of the device shown in FIG. 1.

The rocker elements 16 and 16' have apertures 22 into which fastening elements, such as screws 24, are inserted to mount them on the plate members 10, 12 (see FIG. 5). The rocker elements 16 mounted on the top plate member 10 have a downwardly facing lengthwise convex curvature and ride upon upwardly facing level surfaces of the rocker elements 16' mounted on the bottom plate member 12 (see FIGS. 1 and 4). This arrangement could, of course, be reversed, or both rocker elements of each pair could be curved lengthwise, if desired. Separate formation of the rocker elements 16 and 16' makes it possible to proportion them at sufficient width for adequate strength and stable riding alignment during operation, and also allows a non-metallic material to be used in forming them so that the sound of the rocker action is much improved. Rocker spring units are normally formed entirely of metal, commonly steel, as are the plate members 10, 12 and the springs 14 here, but if the rocker surfaces are formed integrally, as in the previously noted prior U.S. Pat. No. 3,190,693, the metallic contact during rocking can produce a disagreeable sound or give the impression of inferior quality for a chair in which the unit is installed. A much nicer and more reassuring sound is generated by non-metallic rocker elements such as the present invention allows, wherein any sufficiently rigid non-metallic material can be used. Wood is preferred because of its general acceptance for rocker use, but a suitable plastic material could be used as well. Also, such materials offer the further advantage of allowing the contacting rocker surfaces to be configurated in complementary fashion, such as with an interfitting tongue and groove, whenever it is desired to provide positive means for holding the rocker elements in riding alignment.

The top plate member 10 has apertures 26 spaced inwardly from the opposite side edge portions 20 for mounting of the rocker elements 16 on the top plate member 10 with the fastening elements 24. The opposite side edge portions 20 of the top plate member 10 extend beyond the location of the inboard rocker elements 16 and each has a pair of bosses 28 displaced therein which form attaching seats for the rocker springs 14. Each of the bosses 28 has a raised inwardly facing tab portion 30 displaced therein which engages and holds the top end of the rocker spring 14 which is seated thereat. These extending side edge portions 20 of the top plate member 10 also reach laterally beyond the spring-seating bosses 28 to provide lands 32 at each corner of the top plate member 10 which lands have apertures 34 for securing the rocker spring unit to a chair bottom (not shown). The end edges 36 of the corner lands 32 are flanged downwardly so as to add strength, along with the bosses 28, at the extending side edge portions 20.

The bottom plate member 12 also has apertures 38 spaced inwardly from the opposite side edge portions 20 thereof for mounting the rocker elements 16' to its inner face with fastening elements 24 (see FIG. 5) and a large, centrally positioned aperture 40 for attachment by a central staking rivet 42 to the swivel base 18. The side edge portions 20 of the bottom plate member 12 extend from the mounting position of the rocker elements 16' outward and each has a pair of bosses 28 of the same description as those in the top plate member 10 which thus are suitable for seating and engaging the bottom ends of the rocker springs 14 and for strengthening the extending side edge portions 20 of the bottom plate member 12.

The bottom plate member 12 is arranged for swivel mounting about the central staking rivet 42 by complementary grooves 44, 46 concentrically formed in the lower face of bottom plate member 12 and in the upper face of the swivel base 18 to contain bearing balls 48 that support the swiveling action in the manner described in the above-mentioned U.S. Pat. No. 3,190,693.

Use of plate members 10, 12 of the foregoing type eliminates a good portion of the metal forming required in rocker spring units of the usual sort, as well as rendering the strengthening needed for chair attachment and providing relatively easy spring assembly. In addition, the combination of such plate members with separately formed inboard rocker elements 16 and 16' greatly simplifies assembly of the rocker springs 14 and provides the advantages in rocker operation and action that have already been noted.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. A rocker spring unit comprising top and bottom generally flat plate members, rocker springs attached to and extending between opposite edge portions of said plate members, and separate rocker elements attached to said plate members in paired relation inboard of said rocker springs at the respective inner faces of said top and bottom plate members and in symmetrical relation to the attachment of said rocker springs at said opposite edge portions of said plate members, said top plate member extending to provide a land at each corner thereof beyond said rocker springs and said rocker elements for securing the rocker spring unit to a chair bottom thereat.

2. A rocker spring unit as defined in claim 1 and further characterized in that the rocker elements mounted on said top plate member have a downwardly facing lengthwise convex curvature and the rocker elements mounted on said bottom plate member have an upwardly facing level surface.

3. A rocker spring unit as defined in claim 1 and further characterized in that a pair of rocker springs is attached at each opposite edge portion of said plate members, and in that a pair of inboard rocker elements is mounted on said plate members adjacent and parallel to each of said rocker spring pairs.

4. A rocker spring unit as defined in claim 3 and further characterized in that said plate members have opposite side edge portions extending beyond said inboard rocker elements for attachment of said rocker springs, and in that said extending side edge portions have bosses displaced therein which form attaching seats for said rocker springs and by which said extending portions are strengthened.

5. A rocker spring unit as defined in claim 1 and further characterized in that the end edges of said corner lands are flanged downwardly for additionally strengthening said extending side edge portions.

6. A rocker spring unit as defined in claim 1 and further characterized in that said plate members and rocker springs are formed of metal and said inboard rocker elements are formed of a rigid non-metallic material.

7. A rocker spring unit as defined in claim 1 and further characterized in that siad plate members and rocker springs are formed of metal and said inboard rocker elements are formed of wood.

8. A rocker spring unit as defined in claim 1 and further characterized in that said inboard rocker elements are formed of wood, and in that the rocker elements mounted on said top plate member have a downwardly facing lengthwise convex curvature and the rocker elements mounted on said bottom plate member have an upwardly facing level surface.

* * * * *